United States Patent [19]

Ståhl et al.

[11] 4,116,129

[45] Sep. 26, 1978

[54] METHOD FOR PRINTING COMBINATIONS OF SIGNS IN A PREDETERMINED NUMBER AND IN AN IRREGULAR SEQUENCE

[76] Inventors: Uno Arne Ivan Ståhl, Eksjögatan 10; Nils Magnus Håkansson, Allmänningsgatan 5, both of S-253 51 Helsingborg, Sweden

[21] Appl. No.: 711,652

[22] Filed: Aug. 4, 1976

[30] Foreign Application Priority Data

Aug. 8, 1975 [SE] Sweden ..... 7508950

[51] Int. Cl.[2] ..... B41L 47/46

[52] U.S. Cl. ..... 101/426; 101/57; 101/69; 101/109

[58] Field of Search ..... 101/426, 72, 109, 47, 101/57, 58, 53, 55–56, 66, 69, 58, 2; 270/1, 11

[56] References Cited

U.S. PATENT DOCUMENTS

| | | | |
|---|---|---|---|
| 2,619,898 | 12/1952 | Gollwitzer et al. | 101/57 |
| 2,712,788 | 7/1955 | Brown | 101/58 |
| 2,770,186 | 11/1956 | Ehrhard | 101/57 |
| 2,965,019 | 12/1960 | Hayes et al. | 101/53 |
| 3,528,565 | 9/1970 | Binzoni | 101/47 X |
| 3,626,845 | 12/1971 | Whitaker | 101/109 X |

*Primary Examiner*—Edward M. Coven

[57] ABSTRACT

Combinations of signs in a series of a predetermined number of combinations are printed in an irregular sequence by means of printing plates supplied one at a time to a printing station. The sequence of the plates is changed from one print of the series to the other.

3 Claims, 11 Drawing Figures

METHOD FOR PRINTING COMBINATIONS OF SIGNS IN A PREDETERMINED NUMBER AND IN AN IRREGULAR SEQUENCE

BACKGROUND OF THE INVENTION

1. Field of the Invention

This invention relates to a method and an apparatus for printing combinations of signs in a predetermined number and in an irregular sequence.

More particularly the invention relates to a method and an apparatus for printing a series of consecutive numbers in an irregular sequence on a continuous paper web or tape to be separated into individual lottery tickets.

2. Description of the Prior Art

In a prior art lottery ticket-issuing apparatus lottery tickets printed on a continuous paper tape are delivered from a container and are separated into individual tickets one at a time outside the container. The tickets have each a number in a predetermined series of consecutive numbers but the numbers are arranged in an irregular sequence on the tape, and the delivery of the tickets takes place with concealment of the numbers so that nobody can ascertain the number of the ticket which is in turn to be delivered from the lottery ticket-issuing apparatus. Furthermore, a ticket which has been delivered completely or partly from the container cannot be pushed back into the container. Thus, nobody can predict the number of the ticket to be delivered next time and nobody can return to the apparatus a ticket which has been found to give no prize.

Presently the printing of numbers on the ticket tape or web utilized in a lottery ticket-issuing apparatus of the kind referred to is performed in a printing machine by means of a number of printing wheels forming part of the machine, on which there are arranged printing blocks for all numbers of a predetermined series of numbers. The different numbers are printed according to a predetermined scheme, all numbers of each series being printed once in a predetermined sequence but, of course, not in numerical order. The scheme is automatically changed from one print of the series to the other but will be repeated after a predetermined number of prints. In order to extend the variation of the scheme the programming of the printing machine has to be changed which is performed by changing the relative angular positions of the printing wheels. Although this change as such can be made very easily the adjustment of the printing machine after a change of the programming is, however, troublesome and time consuming.

In a lottery apparatus of the kind referred to as in all other games having an alleged accidental dividend the material forming the basis of the game must of course be completely impeccable and must not suffer from a fault or deficiency which provides an advantage or a disadvantage to the organizer of the lottery or to the gambler.

SUMMARY OF THE INVENTION

It is a primary object of the present invention to provide a method and an apparatus for printing a series of a predetermined number of combinations of signs in an irregular sequence wherein all combinations of the series appear once, but only once, and wherein the sequence of the combinations is changed in a simple and effective manner from one print of the series to the other.

It is a further object of the invention to provide a method and an apparatus for printing each and every number of a series of consecutive numbers in an irregular sequence which is changed from one print of the series to the other so that it cannot be foreseen in which order the numbers appear in a printed series.

A still further object of the invention is to provide a method and an apparatus for printing each and every number of a series of consecutive numbers in an irregular sequence each on one of the tickets formed by a continuous web or tape said irregular sequence being changed from one print of the series to the other so that the sequence of numbers in consecutive prints of the series of tickets will be repeated only after a great number of consecutive prints of the series having been made.

Yet another object of this invention is to provide a method and an apparatus for printing in a distinct manner different sign combinations, such as numbers, in a series of such combinations.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the method of the invention for printing combinations of signs in a predetermined number and in an irregular sequence comprises the steps of arranging means for printing combinations of signs on separate plates each for printing at least one combination of signs, feeding the plates one at a time to a printing station, printing the combinations of signs by said means in said printing station, and changing the sequence of the plates before making the next print of the series of combinations of signs.

The invention also provides an apparatus for printing combinations of signs in a predetermined number and in an irregular sequence comprising a number of individual plates, means on each plate for printing at least one combination of signs, a first magazine for receiving said plates, a second magazine for receiving said plates, spaced from said first magazine, a printing station in the space between said magazines for printing said combinations of signs by said plates, means for feeding said plates in a path extending from one of said magazines to the other one of said magazines through said printing station, means for removing selected plates from said path between the printing station and said other magazine, and means for temporarily storing said removed plates and then delivering such plates to said other magazine.

The accompanying drawings, which are incorporated in and constitute a part of this specification, illustrate an embodiment of the invention and, together with the description, serve to explain the principles of the invention.

Reference will now be made in detail to the present preferred embodiments of the invention, examples of which are illustrated in the accompanying drawings.

DESCRIPTION OF THE PREFERRED EMBODIMENTS

Figure 1:
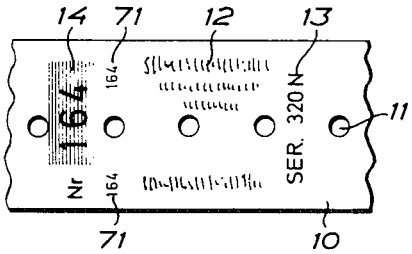
FIG. 1 is a plan view of a lottery ticket on which the printing method of the invention can be applied.

The invention will be described with reference to the printing of a prior art lottery ticket of the type shown in FIG. 1. A tape 10 which has a perforation 11 for engagement with a feeding mechanism in a lottery apparatus has in a known manner a printed text 12 on each individual ticket such text indicating the lottery organizer, the controller of the lottery, the place of delivery of prizes, etc., and a printed series number 13. Furthermore, there is a hatched rectangular field 14 for the ticket number. This text, the series number and the hatched field except the ticket number can all be printed in a known manner in printing units or machinery of a conventional type.

In the hatched region 14 the ticket number is printed according to the method of the invention in the manner and by the machinery described below.

Figure 2:
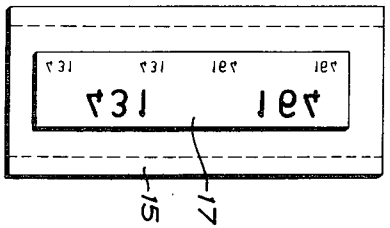
FIG. 2 is a plan view of the lower side of a printing plate for use when printing the ticket of FIG. 1 by the method of the invention.
Figure 3:
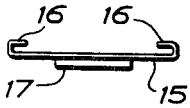
FIG. 3 is an end view of the printing plate of FIG. 2.
Figure 4:
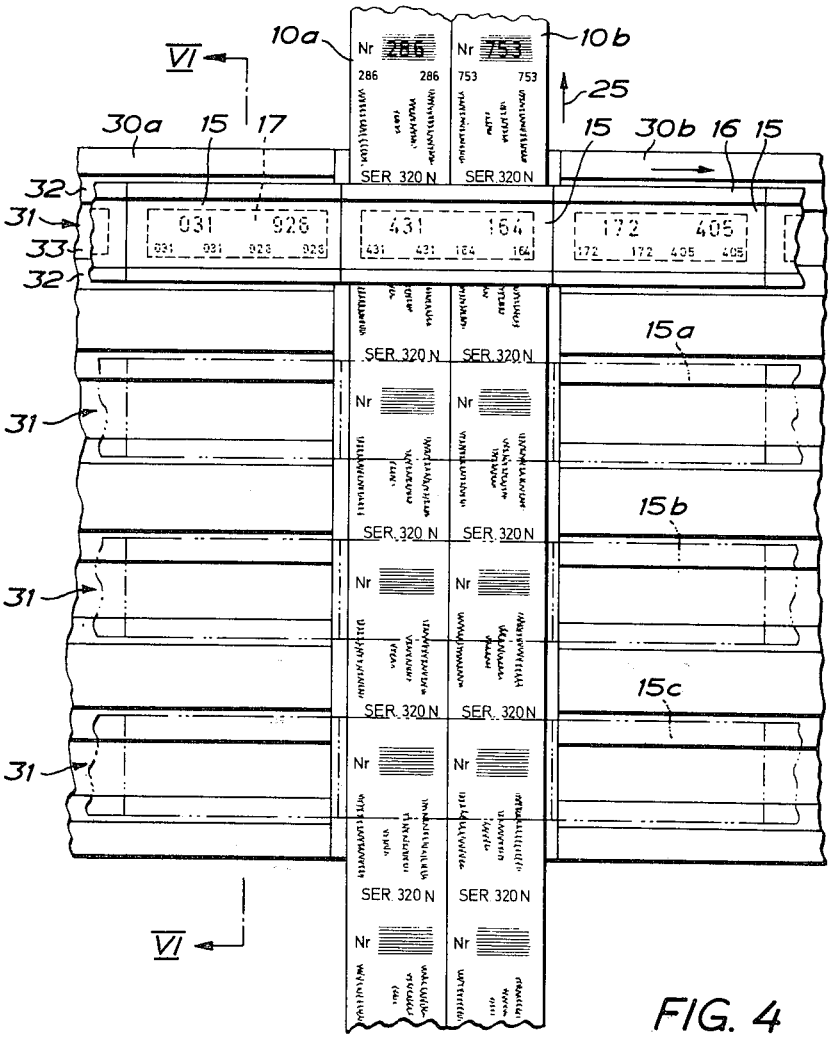
FIG. 4 is a plan view of the arrangement of intercrossing rows of printing plates and ticket tapes.

Referring to FIGS. 2 and 3 there are provided on a rectangular printing plate 15 of sheet metal material, which has along two opposite edges stiffening guide flanges 16, a printing block 17 for two numbers of a complete series of consecutive numbers. This block preferably is made of rubber and it is intended for printing on two paper webs or tapes simultaneously in a single printing operation. This is illustrated in FIG. 4 where a number of printing plates 15 are arranged in four linear paths three of which are indicated by dot and dash lines 15*a* to *c* across two ticket tapes 10*a* and 10*b* at right angles thereto; there can be arranged a further number of rows of printing plates in parallel with the rows shown for printing any desired number of tickets simultaneously in each printing operation. The tapes can comprise two or more separate tapes or a single web which, when the printing has been completed, are cut longitudinally into individual tapes.

Figure 7:
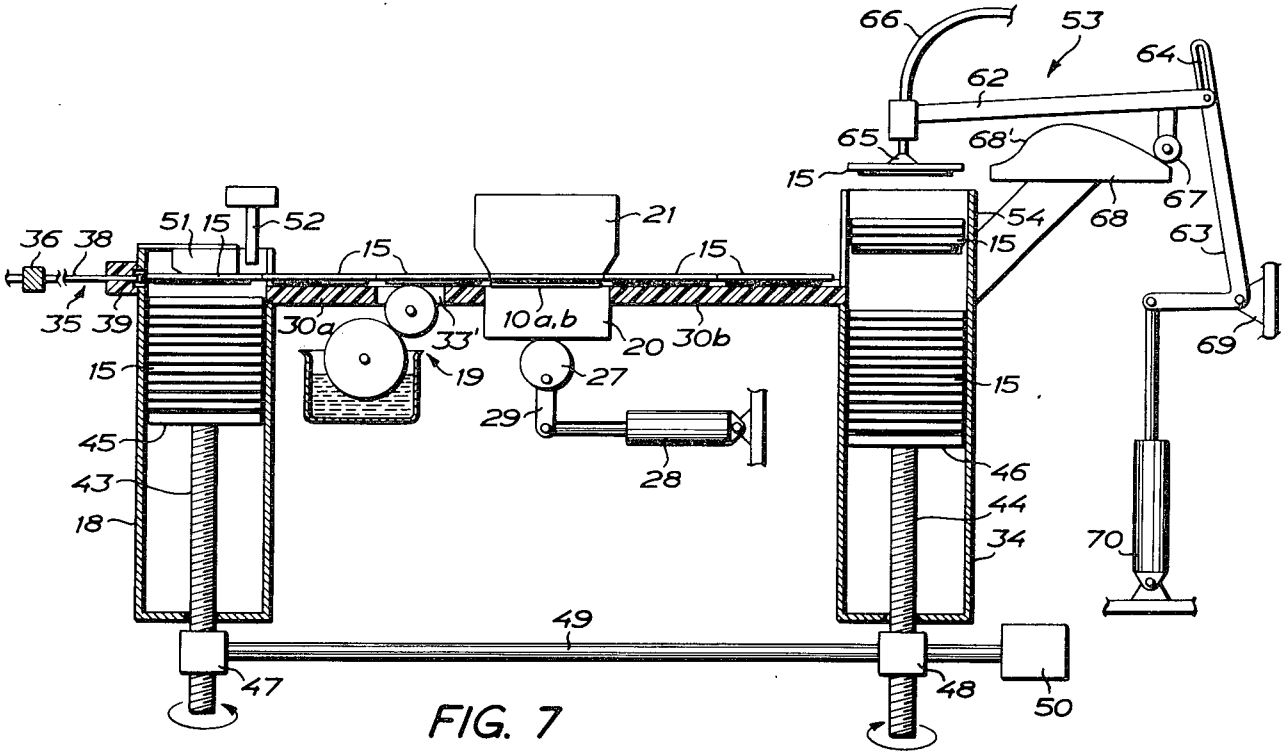
FIG. 7 is a side view of a printing machine of the invention.

Printing plates 15 for each row are stored in a magazine 18, FIG. 7, and are transferred one at a time from the magazine to the row of printing plates. Thereby the printing plates are fed stepwise each step corresponding to the length of a printing plate. During feeding the printing plates are carried past a conventional inking device 19 mounted in the frame of the printing machine and then into a printing unit having an impression hammer 20 and an abutment 21 of which hammer 21 is guided for vertical movement in the frame and abutment 21 is fixedly connected to the frame. The printing plates pass over tapes 10*a* and 10*b* which are pre-printed with text 12, series number 13 and hatched field 14 when they arrive at the printing unit where they pass between hammer 20 and abutment 21.

Figure 5:
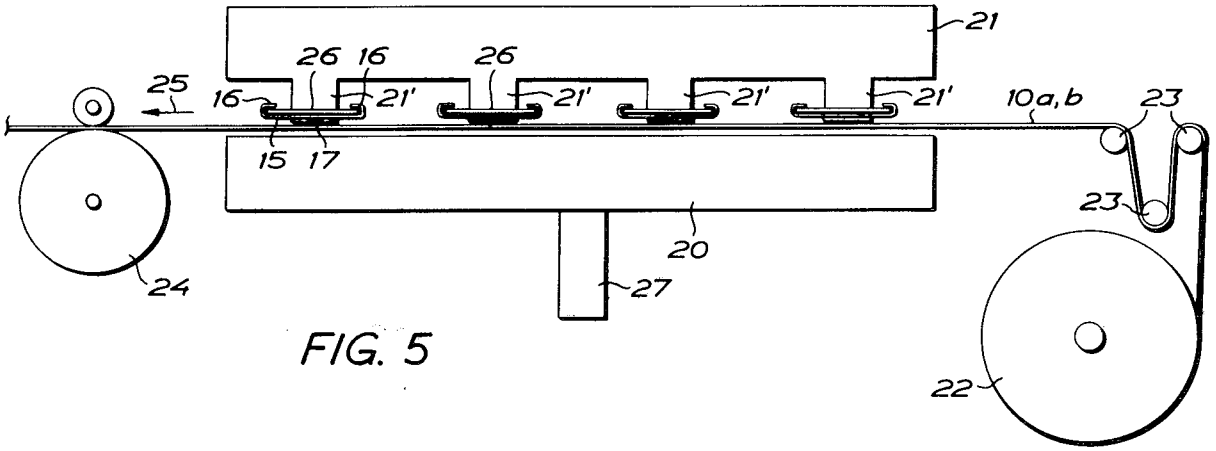
FIG. 5 is a side view of a printing unit for printing the ticket tapes by means of the printing plates, as well as means for storing and feeding the ticket tape.

As shown in FIG. 5 tapes 10*a* and 10*b* or a web sufficiently wide to form the two tapes is drawn from a supply roll 22 over tensioning and equalizing rollers 23 through the space between impression hammer 20 and abutment 21 by means of feed rollers 24 rotatably mounted in the frame and frictionally engaging the tape, in the direction indicated by arrow 25. This feeding movement should be a stepwise movement each step corresponding to the total length of the tickets received by printing unit 20, 21, in this case the length of four tickets. Such stepwise movement can be obtained by stepping drive means, commonly known in the art, which is operatively connected to drive means 24.

Abutment 21 forms raised pressure surfaces 21' the number of which corresponds to the number of rows of printing plates, i.e., four, and each of these raised portions is provided with a flat metal guide rail 26 of such width and thickness that plates 15 can be slid onto the guide rail as is shown in FIG. 5 the flanged edges slidably engaging the edge portions of the rails and forming guide grooves therefor. Thus, the printing plates are suspended by rails 26 from abutment 21 at portions 21' when they are positioned in the printing unit tapes 10*a* and 10*b* passing below printing blocks 17 of the printing plates transversely thereof.

In order to make impressions of printing blocks 17 on tape 10*a* and 10*b* impression plate 20 is reciprocated vertically to press the tapes towards the respective printing blocks. For this purpose there is arranged a cam 27 rotatably mounted in the frame of the printing machine and engaging the lower side of impression hammer 20. This cam is rotated back and forth by means of a doubleacting pneumatic ram of the cylinder and piston type indicated at 28 which is connected with the frame and is coupled to the cam by an arm 29. The movement of cam 27 and the reciprocating movement of impression hammer 20 effected thereby, and the stepwise feeding movement of feeding rollers 24 may be coordinated by hydraulic, electric, or mechanical means in such a way that the tapes 10*a* and 10*b* will be moved one step in the intervals between the printing steps wherein impression hammer 20 is moved towards abutment 21 in order to press the tapes 10*a* and 10*b* against their respective printing blocks 17 which have been inked when passing inking device 19. Such coordination can be realized in different ways well known to the man skilled in the art.

Figure 6:
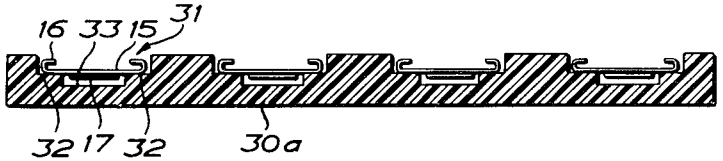
FIG. 6 is a cross sectional view along line VI—VI in FIG. 4.

Printing plates 15 are moved stepwise from magazine 18 to printing unit 20, 21 by means to be described, on a guide plate 30*a* (FIGS. 4, 6 and 7), which forms four channels 31 one for each row of printing plates, wherein the printing plates are supported on shoulders 32 printing blocks 17 being spaced from the bottom 33 of the channel. The guide plate is related to guide rails 26 in such a manner that the printing plates can slide from guide plate 30*a* onto guide rails 26. An opening 33' is provided in guide plate 30*a* and receives inking device 19 for contact with printing blocks 17 on printing plates 15 passing along guide plate 30*a*. On the opposite side of printing unit 20, 21 there is provided a second guide plate 30b registering with the path defined by guide plate 30a and guide rails 26, for receiving printing plates 15 when they are delivered from the printing unit. On this guide plate 30b the printing plates are carried to a receiving magazine 34, FIG. 7.

Figure 8:
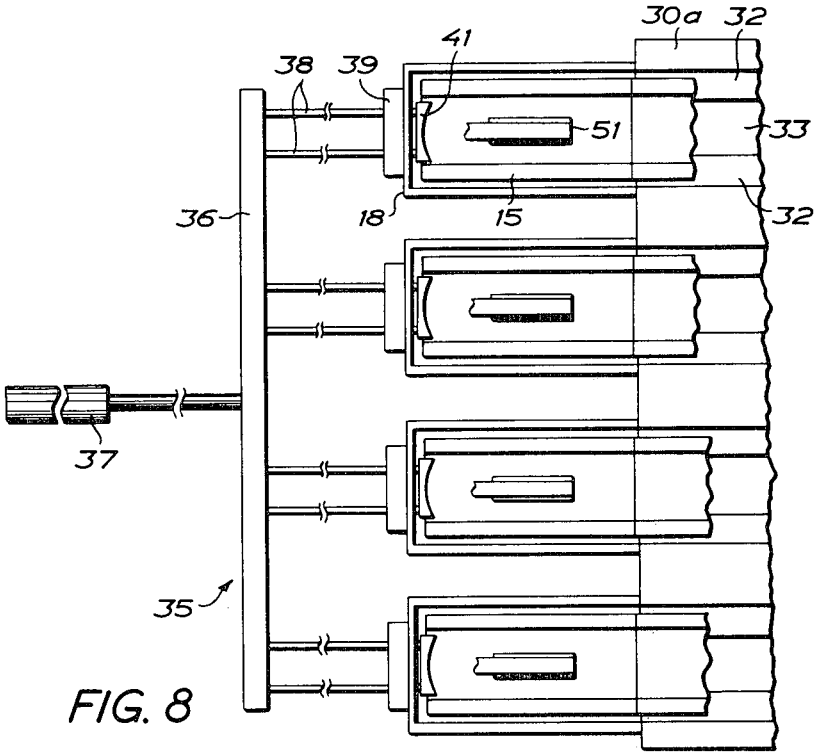
FIG. 8 is an enlarged plan view of a pusher arrangement associated with one of the magazines of the printing machine of FIG. 7.
Figure 9:
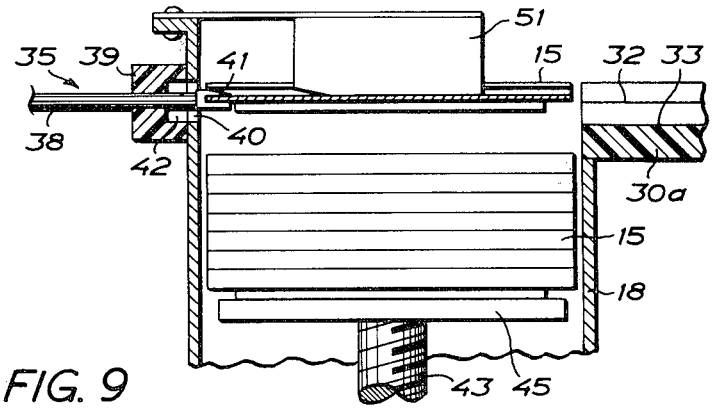
FIG. 9 is a further enlarged fragmentary vertical cross sectional view of the upper portion of the magazine and the pusher arrangement associated therewith.

The stepwise movement of the row of printing plates 15 is effected by means of a pusher 35 which is shown in more detail in FIGS. 8 and 9 and which comprises a cross bar 36 connected to a pneumatic ram of the cylinder and piston type indicated at 37 and supported by the frame of the printing machine. Cross bar 36 carries four pairs of horizontal bars 38 each pair of bars 38 being displaceably guided in a bushing 39 of a suitable plastic material which is mounted to the side wall of magazine 18 in register with an opening 40 therein. A cross bar 41 supported by the inner end of each pair of bars 38 is channelled to receive by accurate sliding fit the edge portion at the adjacent end of a printing plate. This cross bar 41 is received in a recess 42 in bushing 39 when the pusher is in a retracted position, shown in FIGS. 8 and 9. When the pusher is advanced by means of ram 37 to a position in which cross bar 41 is at the opposite side wall of magazine 18, the printing plate 15 registering with the pusher will be pushed out of the magazine. When this occurs the printing plate thus delivered from magazine 18 will push the printing plates on guide plates 30a and 30b and on guide rails 26 one step corresponding to the length of a printing plate, to the right as seen in FIGS. 4 and 7 the spacing between magazine 18 and printing unit 20, 21 and between printing unit and magazine 34 being a multiple of the length of one printing plate 15.

In order to maintain the printing plates 15 in magazines 18 and 34 at such level that the uppermost printing plate in magazine 18 registers with the channelled cross bar 41 of the pusher and the uppermost printing plate in magazine 34 is below the level of printing plates supplied on guide plate 30b in order to allow the printing plate at the right hand end of guide plate 30b to pass into magazine 34 without interfering with printing plates stacked therein there are provided means for controlling the level of printing plates in the magazines.

In the embodiment described such means comprise a vertical screw spindle 43 in magazine 18 and a corresponding vertical screw spindle 44 in magazine 34. These screw spindles are each rotatably connected to a support plate 45 and 46, respectively, guided for vertical displacement in the associated magazine. Each screw spindle is in engagement with a worm drive or gear 47 and 48, respectively, which is fixedly mounted in the frame of the printing machine. These worm drives are operatively connected to a common drive shaft 49 which is in turn connected to a reversible drive motor 50 such as an electric drive motor. The two screw spindles are driven synchronously in opposite directions when shaft 49 is rotated, and thus it will be seen that support plate 45 of magazine 18 will be elevated when support plate 46 of magazine 34 is being lowered, and vice versa.

In order to keep the uppermost printing plate 15 of a pile or stack of printing plates supported by plate 45 in magazine 18 in a position accurately adjusted such that the uppermost printing plate will be engaged by cross bar 41 of pusher 35 when advanced to the right as seen in FIGS. 7 to 9 there is provided in magazine 18 a permanent magnet 51 which attracts the uppermost printing plate when it comes close to the magnet and separates it from the pile or stack of printing plates. Thus, the uppermost printing plate will be held suspended by the magnet adhering thereto as shown in FIG. 9 so that the printing plate can be moved unobstructedly by means of the advancing pusher engaged therewith.

The operation of motor 50 is controlled by an electronic sensor probe 52 which is operatively connected to motor 50 and deenergizes the motor when the uppermost printing plate of the pile or stack in magazine 18 is at such distance below magnet 51 that the magnet can attract said uppermost printing plate. When this printing plate has been pushed away motor 50 will be energized again to raise the pile but not until the pusher has been withdrawn so as not to interfere with the movement of the pusher.

The two support plates 45 and 46 are interrelated in such a way that the support plate of magazine 34 will be moved stepwise in correlation with the controlled movement of support plate 45 of magazine 18, to a position in magazine 34 in which the right hand end plate of the row of printing plates can be unobstructedly deposited on the top of the pile or stack received by magazine 34 when such row is pushed one step to the right as described above.

If it is assumed that each number series comprises 1,000 numbers there can be printed by means of the embodiment of the printing plates disclosed herein, two series by using 1,000 printing plates.

In order to obtain a variation of the numerical order of the tickets of consecutive series prints of tickets the printing plates are shuffled automatically. For this purpose there is provided a picket 53 for removing certain printing plates from the row for instance each fifth or each tenth printing plate or any other number of plates. The removal can also take place irregularly under the control of a programmed control device. The printing plates removed are deposited into an auxiliary magazine 54 and the printing plates collected therein can be added to the printing plates received by magazine 34 at selected intervals.

Figure 11:
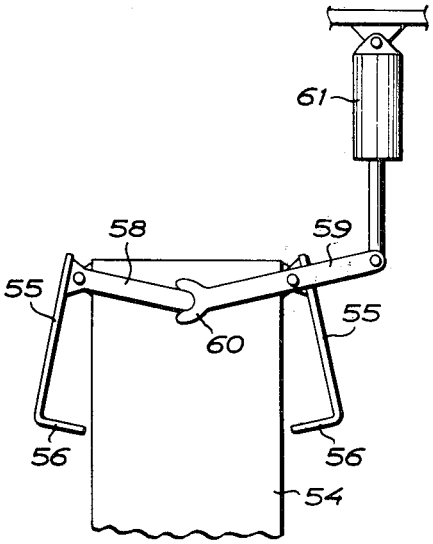
FIG. 11 is a side view of the auxiliary magazine of FIG. 10.

Auxiliary magazine 54 forms an upward extension of magazine 34. To opposite sides of magazine 54 there are pivotally mounted two flaps 55 for swinging movement about horizontal axes at the upper ends thereof, and these flaps have at the lower ends thereof inwardly projecting flanges 56. The flaps can be pivoted from the position disclosed in FIG. 10 in which the flanges project into magazine 54 through openings 57 in the side walls thereof, to the position disclosed in FIG. 11, in which the flanges are withdrawn from openings 57.

For the operation of the flaps between the positions described there is provided an arm 58 on one flap and a doublearmed lever 59 on the other flap a forked end 60 of the lever engaging the free end of arm 58. The opposite end of lever 59 is connected to a ram of the cylinder and piston type indicated at 61 which is supported by the machine frame. The piston thereof is spring biased to an upper position corresponding to the condition of FIG. 11 in which flaps 55 are withdrawn. When ram 61 is pressurized the flaps are swung to the positions shown in FIG. 9.

Figure 10:
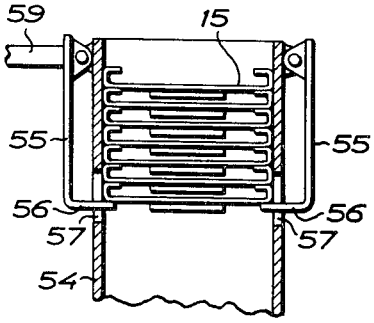
FIG. 10 is a vertical sectional view of an auxiliary magazine associated with one of the magazines of the printing machine of FIG. 7.

As seen in FIG. 7 the picker comprises an arm 62 which is pivoted to a swing arm 63 in a slot 64 at one end and carries a suction cup 65 at the other end. The suction cup is connected to a vacuum source through a hose 66. Between the ends arm 62 is provided with a roller 67 rotatably mounted to the arm, and this roller runs on a cam surface 68' formed by a cam 68 fixedly mounted in the frame of the printing machine. Swing arm 63 is pivoted to the frame at 69 and is connected to a pneumatic ram of the cylinder and piston type indicated at 70, for moving the swing arm back and forth. During such movement roller 67 runs on cam surface 68' which has such configuration that suction cup 65 will perform a movement between two end positions. In one position it contacts a printing plate 15 on guide plate **30*b* and in the other position it is above auxiliary magazine 54. The vacuum in suction cup 65 is controlled in a manner well known in the art in dependence of the movement of arm 62 such that vacuum will be applied when the suction cup contacts the printing plate on guide plate 30*b* and will be maintained until the printing plate is exactly above magazine 58. Then, the vacuum is broken down and the printing plate will be dropped into magazine 54 and deposited on flanges 56 normally held in the position in which they project into magazine 58 as shown in FIG. 10, or on top of a pile or stack built up in magazine 54 on flanges 56**.

By means of a programming unit the suction cup may be arranged to pick up at intervals the printing plates passing to magazine 34 and deposit them into auxiliary magazine 58 from which the pile or stack of printing plates built up therein may be delivered at intervals to magazine 34. Thus, it will be seen that the order in which the printing plates have come into operation in printing unit 20, 21 will be disturbed when the printing plates are received by magazine 34 wherein the order of the printing plates will be different from that in magazine 18.

When the series of numbers has been printed the following series will be printed with the printing plates in the new sequence provided by picking and adding predetermined printing plates in the manner described. For this purpose the pile or stack of printing plates may be transferred manually to magazine 18 or each magazine may have pusher 35 as well as picker 53 and auxiliary magazine 54 such that each magazine 18 or 34 may be used as delivering magazine or as receiving magazine. However, in that case a further inking device has to be provided between printing unit 20, 21 and magazine 34. Moreover it will be necessary to arrange magnets 51 so that they can be moved out of the passage between auxiliary magazine 54 and magazine 18 and 34, respectively, when the magazine is being used as the receiving magazine.

Inasmuch as removal takes place in all rows of printing plates there will be obtained in this manner a nearly indefinite variation of the numerical order of the different series.

By using a number of separate printing plates it will be guaranteed that all numbers will be included in each series and that no number will be printed two times in a series. The print will be very clear and distinct by using the planar printing plates; when printing wheels are used it may occur that the figures sometimes are blurred.

In order to ensure that there will be no doubt about the number which is intended in case an obscurity nevertheless should arise regarding the number printed in the hatched field 14 two smaller control numbers may be printed simultaneously with said number at one edge and the other, respectively, of the ticket immediately below and in parallel with the hatched field as is shown at 71 in FIG. 1, a possibility which is not available when printing wheels are being used.

Each printing plate can be provided with a single printing block for printing one or more numbers in a number series. One single ticket strip at a time can be printed but it is also possible to print two or more ticket strips at the same time. The printing plates which are removed to the auxiliary magazine 54 can be added at the beginning or at the end of the rest of the printing plates before the next printing but they can also be introduced anywhere among these plates at one or more places. It is of no importance where they are introduced provided they will not be at the same place as before; the risk of this happening is exceedingly small. It is of course essential that all printing plates removed will be included at the insertion so that there will be no gap in the number series.

The operations performed in the printing machine may be controlled by a programmed control apparatus in the correct correlation and sequence. This technique is prior art and it would not be necessary to describe such apparatus here.

It is not only lottery tickets of the kind referred to above that can be printed by using the method and apparatus of the invention. Also in other connections where the object is to print different combinations of signs the invention is applicable in order to ensure that there will be printed a complete series and that there will be obtained a variation of the sequence from one print of the series to the other without unintended doubling of any combination of signs.

We claim:

1. A method for printing a predetermined number of signs in a plurality of different successive sequences and in an irregular and unpredictable order in each sequence, wherein in each sequence the signs are assembled in a nonrepetitive order that is different from the order in preceding and succeeding sequences, which comprises the steps of (a) providing the signs on a number of plates, each plate carrying at least one sign;
(b) arranging the plates in a first order;
(c) feeding the plates one at a time to a printing station;
(d) printing with the plates in the first order at said printing station;
(e) collecting the plates after the printing, and
(f) rearranging the plates in a second order different from the first order;
(g) printing with the plates in the second order;
(h) continuing to rearrange the plates in each successive sequence to an order different from the order in the preceding and succeeding sequences; and printing with the plates in each sequence in an unpredictable order that is nonrepetitive in successive sequences.

2. A method as claimed in claim 1 wherein the printing plates are rearranged in each successive sequence by removing selected plates after the printing and by returning these plates in a different position with respect to the rest of the plates for the next sequence.

3. A method as claimed in claim 2 wherein the plates are stored in a stack, and the plates are rearranged for the next successive sequence by removing them from the stack and returning them to the stack in a different position with respect to other plates in the stack.

* * * * *